US005428381A

United States Patent [19]

Hadimioglu et al.

[11] Patent Number: 5,428,381

[45] Date of Patent: Jun. 27, 1995

[54] CAPPING STRUCTURE

[75] Inventors: Babur B. Hadimioglu, Mountain View; Martin G. Lim, Foster City, both of Calif.

[73] Assignee: Xerox Corporation, Stamford, Conn.

[21] Appl. No.: 100,525

[22] Filed: Jul. 30, 1993

[51] Int. Cl.[6] ..... B41J 2/04

[52] U.S. Cl. ..... 347/46

[58] Field of Search ..... 346/140 R; 347/44, 46, 347/47; B41J 2/04

[56] References Cited

U.S. PATENT DOCUMENTS

| | | | |
|---|---|---|---|
| 4,166,277 | 8/1979 | Cielo et al. | 346/140 R |
| 5,028,937 | 7/1991 | Khuri-Yakub et al. | 346/140 R |
| 5,111,220 | 5/1992 | Hadimioglu et al. | 346/140 R |
| 5,229,793 | 7/1993 | Hadimioglu et al. | 346/140 R |
| 5,287,126 | 2/1994 | Quate | 346/140 R |

FOREIGN PATENT DOCUMENTS 62-170350 7/1987 Japan .

*Primary Examiner*—Benjamin R. Fuller
*Assistant Examiner*—Alrick Bobb

[57] ABSTRACT

Droplet ejectors having a plurality of droplet ejecting ports capable of ejecting ink droplets onto a recording medium and having a capping structure that alleviate debris contamination. The capping structure includes a plurality of openings, some of which allow ejected droplets to pass onto the recording medium. The capping structure is removably spaced above the remainder of the droplet ejector using spacers which mate with others openings in the capping structure.

4 Claims, 4 Drawing Sheets

CAPPING STRUCTURE

This invention relates to capping structures which reduce contamination in ink droplet ejecting printers.

BACKGROUND OF THE INVENTION

Various droplet ejecting printer technologies have been or are being developed. One such technology, acoustic ink printing (AIP), uses focused acoustic energy to eject a marking material (generically referred to herein as ink) onto a recording medium. For a more detailed description of acoustic ink printing, reference may be made to U.S. Pat. Nos. 4,308,547, 4,697,195, and 5,028,937, and the citations therein.

A concern in AIP printing is keeping debris, such as paper dust, from contaminating the droplet ejectors and thereby reducing print quality. Contamination may affect the droplet ejectors in at least three ways. First, debris can disturb the location of the free surface of the ink, thereby disturbing the very important spatial relationship between the acoustic energy's focal area and the free surface of the ink. Second, debris can partially or completely block the path between the ink and the recording medium. Third, debris can disturb the internal flow path of the ink inside the droplet ejector, preventing replenishment of ejected ink.

Thus, cap structures which alleviate debris contamination of print quality are beneficial. Such structures are even more beneficial if they can be fabricated at low cost. Preferably, such capping structures should be removable to allow cleaning.

SUMMARY OF THE INVENTION

The present invention provides for droplet ejectors having capping structures that alleviate debris contamination, that can be fabricated at low cost, and that can be implemented such that removal of the capping structure from the remainder of the droplet ejector is possible.

A droplet ejector suitable for practicing the present invention includes a plurality of droplet ejecting ports capable of ejecting ink droplets onto a recording medium. Over the droplet ejecting ports is a capping structure having a plurality of openings, some of which align with the droplet ejecting ports. The aligned openings allow ejected ink droplets to pass onto a recording medium. Other openings align with spacers that retain the capping structure in place. The capping structure beneficially is implemented such that it is removable.

BRIEF DESCRIPTION OF THE DRAWINGS

Aspects of the present invention will become apparent as the following description proceeds and upon reference to the drawings, in which.

DETAILED DESCRIPTION OF THE ILLUSTRATED EMBODIMENT

The present invention provides for droplet ejecting printers that include capping structures which alleviate debris contamination. While other ejection type printers may also benefit from the present invention, the present invention is particularly useful in acoustic ink printers. Thus, acoustic droplet ejectors are used as the illustrative embodiments.

A FIRST ACOUSTIC DROPLET EJECTOR ACCORDING TO THE PRINCIPLES OF THE PRESENT INVENTION

Figure 1:
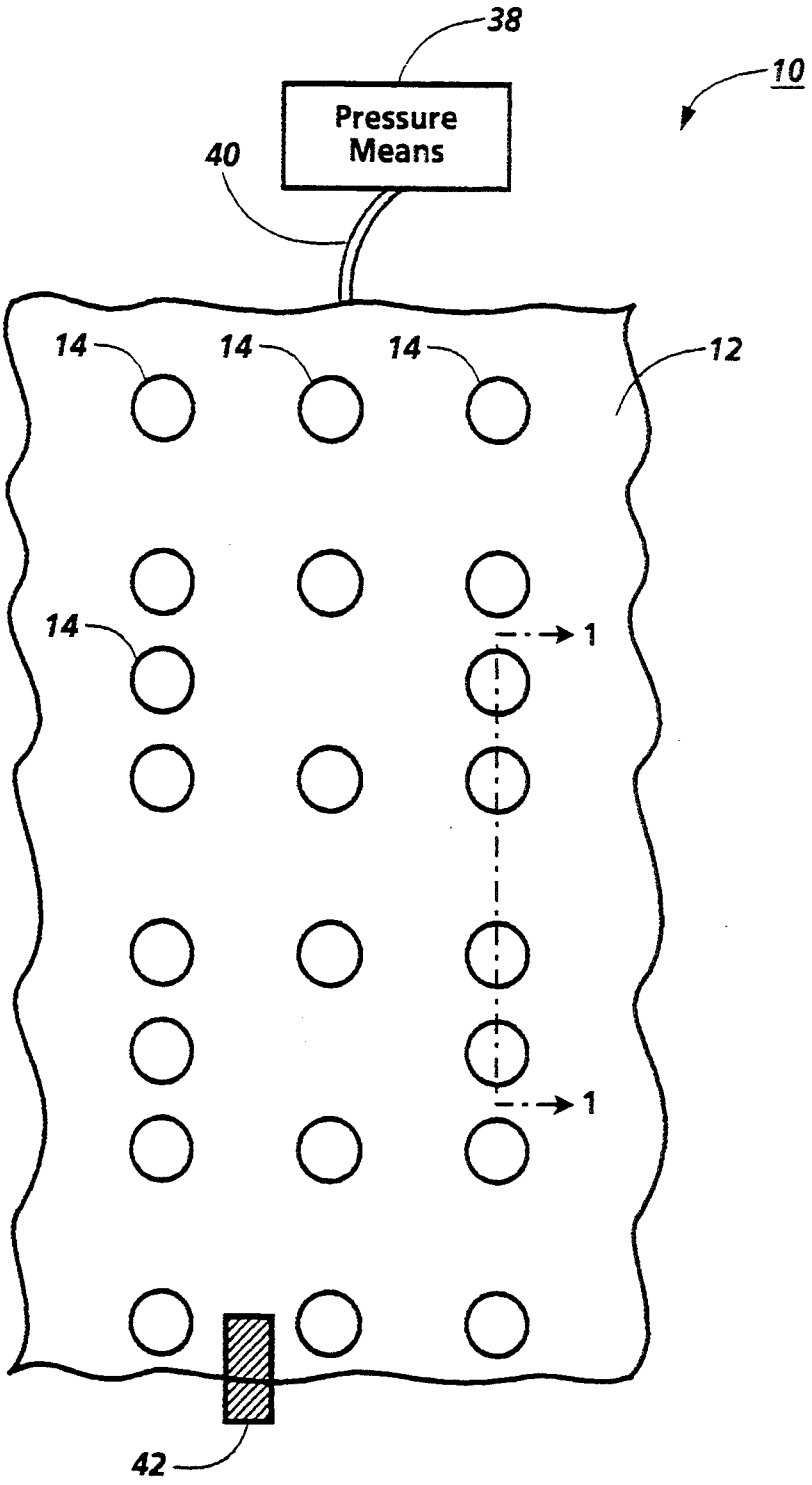
FIG. 1 shows a top-down view of a first embodiment acoustic droplet ejector according to the principles of the present invention.

Turn now to FIG. 1 for a top-down view of an illustrative acoustic droplet ejector 10 that incorporates a capping structure 12 having a plurality of openings 14. The capping structure is about a 4 mil thick slab of silicon. In practice, the number of openings 14 may number in the thousands. As subsequently explained, many of the openings 14 provide passages for ejected ink droplets to pass onto a recording medium (not shown in FIG. 1, but shown in FIG. 2). Others of the openings 14 assist in spacing the capping structure 12 above the remainder of the acoustic droplet ejector 10 (see below). Except for the subsequently described spacing element, the remainder of the acoustic droplet ejector is referred to hereinafter as the base. A cut-away view of a section of the acoustic droplet ejector in FIG. 1, taken along the lines 1—1, is shown in FIG. 2.

Figure 2:
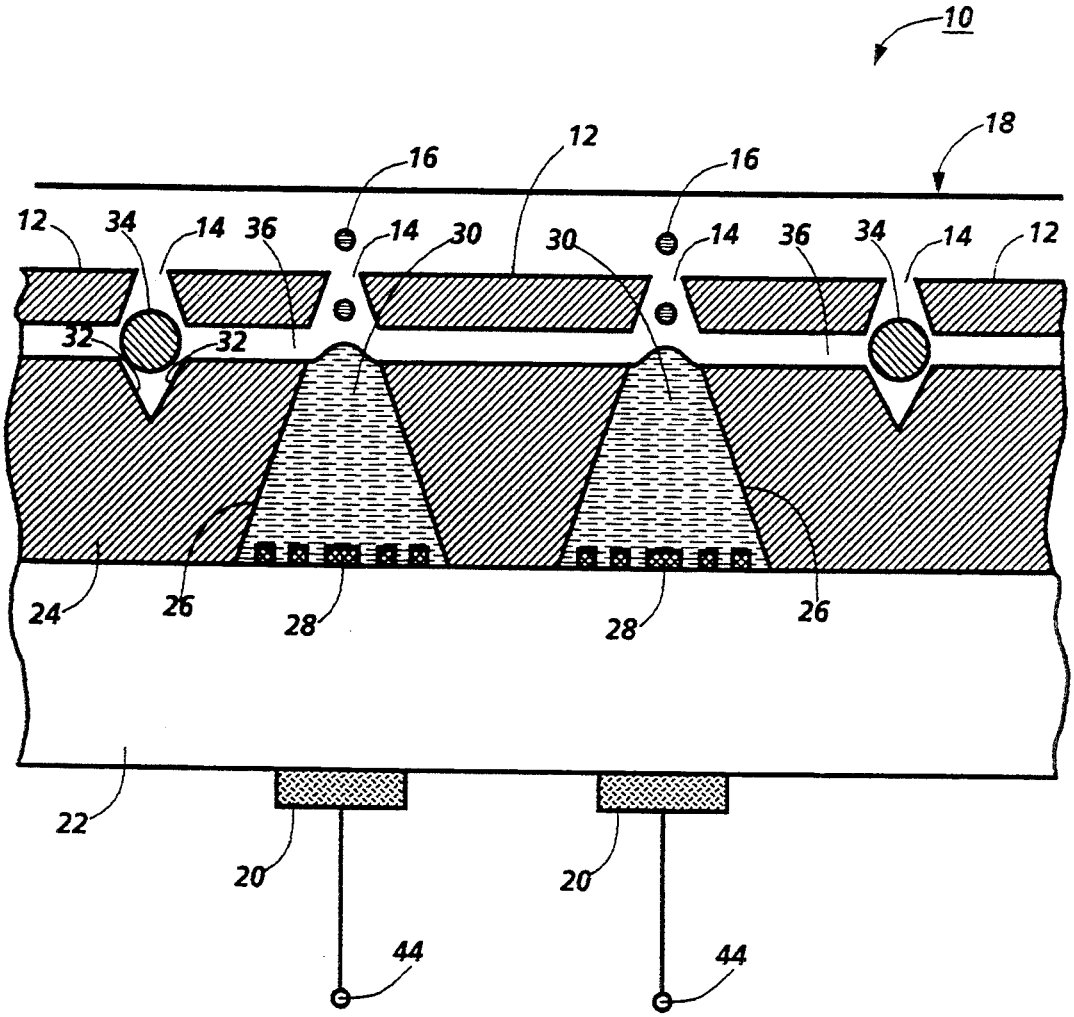
FIG. 2 shows a simplified and unscaled cut-away view of the acoustic droplet ejector shown in FIG. 1.

Referring now to FIG. 2, the openings 14 are pyramidally shaped (wider at the bottom than at the top). The openings 14 allow the individual droplet ejectors of the acoustic droplet ejector 10 to eject droplets 16 of ink (a generic term used for any marking material) onto a recording medium 18. While only two individual droplet ejectors (see below) are shown in FIG. 2, in practice there may be thousands.

Droplet ejection is via acoustic energy derived from ZnO transducers 20 deposited on a 50 mil thick 7740 glass (pyrex) substrate 22 having polished top and bottom surfaces. On the top surface of the substrate 22 is a channel plate 24 comprised of a 300 micron thick wafer of <100> silicon, also polished on its top and bottom surfaces. The channel plate 24 includes a plurality of apertures 26 that are aligned with the openings 14 through which droplets 16 are to be ejected. On the substrate 22, within the apertures 26, and also aligned with the openings 14 through which droplets are to be ejected, are fresnel acoustic lenses 28. While the lenses 28 in the illustrated embodiment are silicon, oxy-nitride is a promising substitute. The substrate 22 and the apertures 26 of the channel plate 24 form an ink well for a marking fluid 30 from which the droplets 16 are ejected. Each transducer and its associated ink well forms an individual droplet ejector.

The channel plate further includes indentations 32 which aligns with openings 14 that are used to space the capping structure 12 above the base of the acoustic droplet ejector 10. Between the indentations 32 and their aligned openings 14 are located spacing balls 34. The balls may be made from a wide range of materials, including ceramic and stainless steel. The diameter of the spacing balls, the angles of the indentations 32, and the dimensions of the openings 14 control the gap 36 between the capping structure and the base. While this gap is not critical, it cannot be so thick that ejected droplets do not reach the recording medium.

Turning back to FIG. 1, the gap 36 (see FIG. 2) is beneficially pressurized by a pressure means 38 connected to the gap via an inlet 40.

DROPLET EJECTION

To eject a droplet, acoustic energy is generated by one of the transducers 20 in response to input electrical energy 44. The acoustic energy passes through the substrate 22 and irradiates an associated acoustic lens 28. That acoustic lens focuses the acoustic energy into a focal area near the free surface of the ink 30. In response, a droplet 16 is ejected through the associated opening 14 onto the recording medium 18.

OPERATION OF THE CAPPING STRUCTURE

Except for the passages provided by the openings 14, the capping structure 12 itself does not directly participate in droplet ejection. Rather, the capping structure 12 protects the base from debris, particularly paper dust from the recording medium 18 if the recording medium is paper. Debris which falls onto the capping structure is restrained from falling onto the base. Further, debris which falls near or into the openings 14 through which droplets are ejected are blown away by air from the pressure means 38. Finally, the capping structure reduces the humidity near the recording medium due to the reduced surface area for evaporation of the marking fluid.

The capping structure 12 may be removed from its location above the base by lifting it from the spacing balls. This enables cleaning of the capping structure and the clearing of any clogged openings 14. Of course a restraining mechanism may be needed to keep the capping structure connected to the spacing balls during operation. The droplet ejector 10 includes a clip 42 for retaining the capping structure 10 in position.

AN ALTERNATIVE EMBODIMENT DROPLET EJECTOR

The present invention anticipates many modification to the first illustrative embodiment. Two of which may be particularly useful are: 1) to use a different size for the openings 14 that space the capping structure than those that pass ink droplet, and 2) to use nonspherical spacers.

Figure 3:
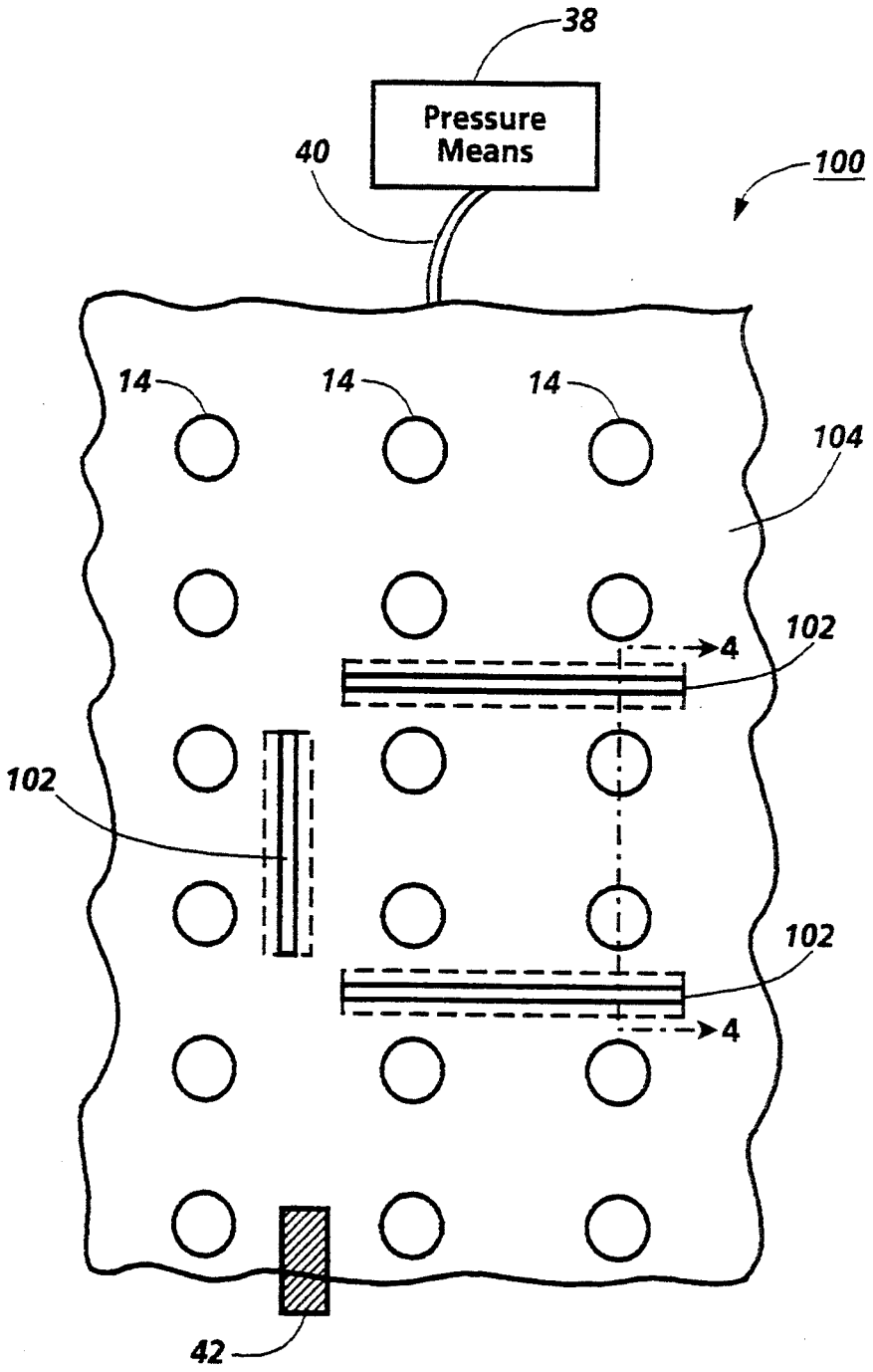
FIG. 3 shows a top-down view of a second embodiment acoustic droplet ejector according to the principles of the present invention.

Regarding the second modification, cylindrical spacers such as fiber optic strands are particularly useful. An illustrative embodiment acoustic droplet ejector 100 which uses cylindrical spacers is shown in FIG. 3. In the acoustic droplet ejector 100, the openings 14 that are used to space the capping structure 12 above the base in FIGS. 1 and 2 are replaced with grooves 102.

The grooves 102 are aligned along two axes. This permits the capping structure to be accurately placed in two dimensions as will become subsequently apparent. However, the resulting new capping structure 104 retains the openings 14 that permit the ejection of ink droplets onto the recording medium.

Figure 4:
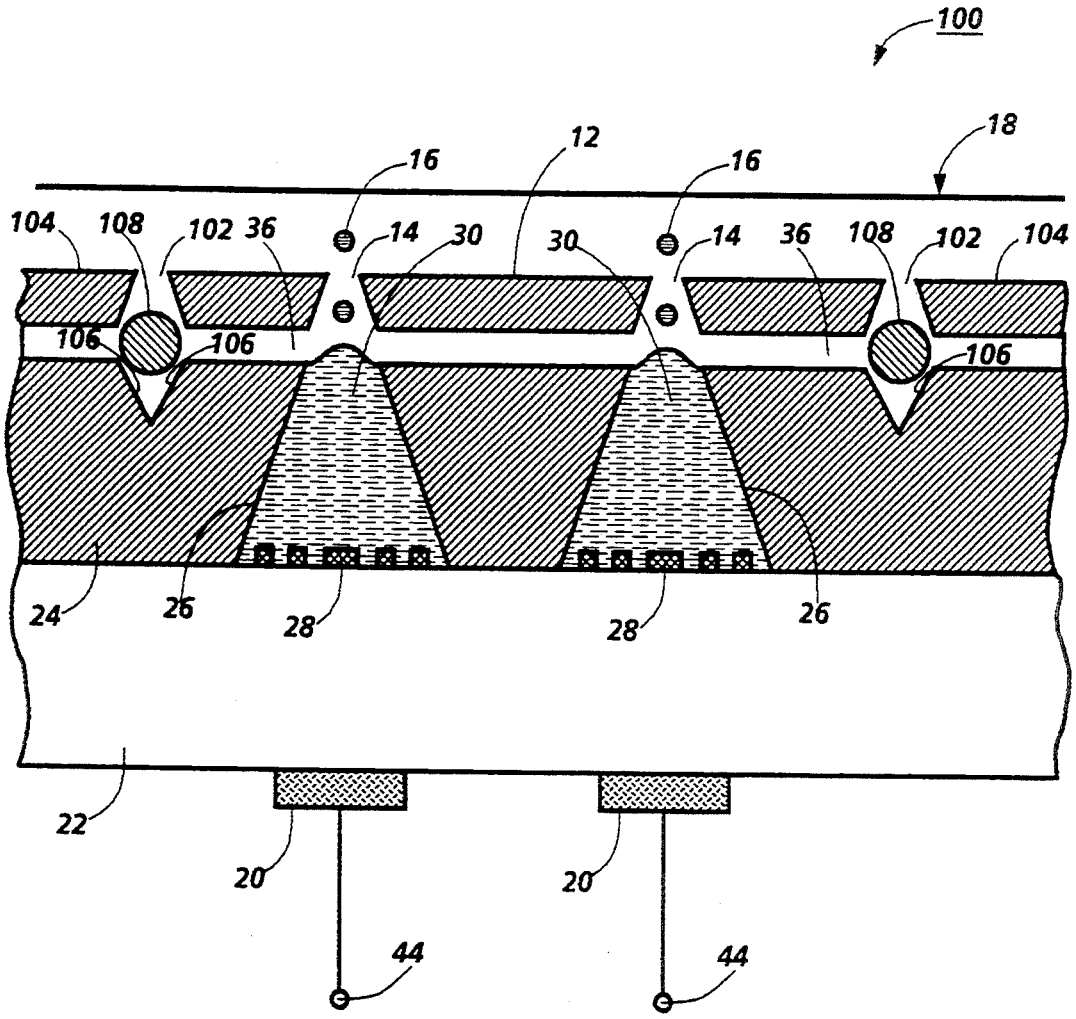
FIG. 4 shows a simplified and unscaled cut-away view of the acoustic droplet ejector shown in FIG. 3.

A cut-away view of a section of the acoustic droplet ejector 100 in FIG. 3, taken along the lines 4—4, is shown in FIG. 4. In place of the indentations 32 and spacer balls 34 used in the acoustic droplet ejector 10 (see FIG. 2), the acoustic droplet ejector 100 has elongated grooves 106 and cylindrical spacers 108, such as a fiber optic strand. Fiber optic strands are particularly useful since they are readily available and have very accurately controlled dimensions. An advantage of the acoustic droplet ejector 100 is that the capping structure 104 is easily positioned in place over the base since the grooves 102 run along two axes. However, the acoustic droplet ejector 100 is somewhat more difficult and expensive to fabricate.

FABRICATION OF THE CAPPING STRUCTURES

The capping structures 12 and 104, and their variations, may be fabricated in a number of ways. To produce large quantities of capping structures, each having a large number of defined features such as openings and grooves, the use of semiconductor fabrication techniques are beneficial. In this case the capping structures should be made of a suitable material such as crystalline silicon.

However, in other applications, materials such as glass, any of a large number of plastics, or metal shim stock can be used. The cap structure's various features may then be formed using chemical etching, mechanical drilling, laser drilling, or ultrasonic drilling.

From the foregoing, numerous modifications and variations of the principles of the present invention will be obvious to those skilled in its art. Therefore, the scope of the present invention is to be defined by the appended claims.

What is claimed is:

1. An acoustic droplet ejector comprising:
   - a substrate;
   - a channel plate with an aperture that is attached to said substrate such that said aperture and said substrate form a holder for an acoustically conductive material, said channel plate having a plurality of indentations;
   - a transducer for converting input electrical energy into acoustic energy which passes through said holder;
   - an acoustic lens for receiving said acoustic energy and for focusing said acoustic energy within said holder into a focal area at a predetermined position;
   - a plurality of spacers located within said indentations and which protrude from said channel plate; and
   - capping structure having a plurality of openings, some of said openings mating with said spacers such that said capping structure is removably spaced apart from said channel plate by a gap, and such that other openings of said plurality of openings permit droplets to be ejected by said acoustic energy to pass through said capping structure.

2. The droplet ejector according to claim 1, wherein said spacers are substantially spherical.

3. The droplet ejector according to claim 1, wherein said spacers are substantially cylindrical.

4. The droplet ejector according to claim 1, further including a pressure means for pressuring the gap between said capping structure and said channel plate such that debris is blown away from said other openings.

* * * * *